US010170881B2

(12) United States Patent
Zebhauser

(10) Patent No.: US 10,170,881 B2
(45) **Date of Patent: *Jan. 1, 2019**

(54) METHOD OF MANUFACTURING AN INSERTION-TYPE CONNECTOR

(71) Applicant: Rosenberger Hochfrequenztechnik GmbH & Co. KG, Fridolfing (DE)

(72) Inventor: Martin Zebhauser, Laufen (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 40 days.

This patent is subject to a terminal disclaimer.

(21) Appl. No.: 15/339,305

(22) Filed: Oct. 31, 2016

(65) Prior Publication Data

US 2017/0047699 A1 Feb. 16, 2017

Related U.S. Application Data

(63) Continuation of application No. 14/363,693, filed as application No. PCT/EP2012/004891 on Dec. 3, 2012, now Pat. No. 9,490,601.

(30) Foreign Application Priority Data

Dec. 9, 2011 (DE) ..... 10 2011 120 761

(51) Int. Cl.

| | |
|---|---|
| ***H01R 43/00*** | (2006.01) |
| ***H01R 43/16*** | (2006.01) |
| ***H01R 43/24*** | (2006.01) |
| ***H01R 43/02*** | (2006.01) |

(52) U.S. Cl.

CPC ..... *H01R 43/16* (2013.01); *H01R 43/02* (2013.01); *H01R 43/24* (2013.01); *Y10T 29/49222* (2015.01)

(58) Field of Classification Search

CPC .. H01R 12/716; H01R 43/16; H01R 12/7064; H01R 12/592; H01R 12/725; H01R 13/631; Y10T 29/49174; Y10T 29/49204; Y10T 29/49222

USPC .... 29/884, 874, 882, 883; 439/60, 189, 544, 439/660, 733.1, 885, 937

See application file for complete search history.

(56) References Cited

U.S. PATENT DOCUMENTS 4,875,877 A * 10/1989 Fleak ..... H01R 13/648 439/108
5,060,372 A 10/1991 Capp
5,062,809 A 11/1991 Sakamoto
(Continued)

FOREIGN PATENT DOCUMENTS

CN 201904456 7/2011
EP 1998406 A1 12/2008
(Continued)

*Primary Examiner* — Thiem Phan
(74) *Attorney, Agent, or Firm* — DeLio, Peterson & Curcio, LLC; Robert Curcio

(57) ABSTRACT

A method of manufacturing an insertion-type connector having at least two mutually electrically insulated conductor contacts with the conductor contacts cut from a metal sheet in such a way that they are connected together via a connecting part of the metal sheet, the conductor contacts being partly embedded in an electrically insulating material to form an electrically insulating housing which fixes the conductor contacts relative to one another, and the connecting part then separated off.

11 Claims, 3 Drawing Sheets

(56) References Cited

U.S. PATENT DOCUMENTS

| | | | | |
|---|---|---|---|---|
| 6,125,535 | A | 10/2000 | Chiou | |
| 6,641,411 | B1 | 11/2003 | Stoddard | |
| 7,959,478 | B2 * | 6/2011 | Chiu ..... | H01R 13/65802 439/885 |
| 2002/0098720 | A1 | 7/2002 | Noda | |
| 2004/0092169 | A1 | 5/2004 | Aldridge | |
| 2008/0050969 | A1 | 2/2008 | Josephson | |

FOREIGN PATENT DOCUMENTS

| | | |
|---|---|---|
| JP | 62073489 | 5/1987 |
| JP | 3266383 | 11/1991 |
| JP | 2002231393 | 8/2002 |

* cited by examiner

METHOD OF MANUFACTURING AN INSERTION-TYPE CONNECTOR

BACKGROUND OF THE INVENTION

1. Field of the Invention

The invention relates to a method of manufacturing an insertion-type connector having a plurality of first, mutually electrically insulated, conductor contacts which are cut from a metal sheet in such a way that they are connected together via a connecting part of the metal sheet, and having a plurality of second conductor contacts which are connected together and which are cut from a metal sheet, the conductor contacts being partly embedded in an electrically insulating material to form an electrically insulating housing which fixes the conductor contacts relative to one another, and the connecting part then being separated off.

2. Description of Related Art

Insertion-type connectors of this kind are generally produced by manufacturing, separately, the individual conductor contacts, an insulator which receives the conductor contacts and mutually insulates them, and a housing which receives the conductor contacts and the insulator, and then assembling these individual components. When this is done, provision may also be made for the housing, if formed from an electrically insulating material, to perform the function of the insulator as well.

This way of manufacturing an insertion-type connector involves in particular considerable costs for the assembly work, which increase the unit costs of the individual insertion-type connectors. Because insertion-type connectors are usually mass-produced articles for which only low unit costs are acceptable, the reduction of costs is a fundamental aim of the development work done on them.

Known from US 2004/0092169 A1 is a method of manufacturing an insertion-type connector in which two subarrays of signal contact members, which arrays are held parallel to one another at one end via respective connecting strips, are connected together by means of the connecting strips. Plastics material is then molded around the contact terminals of the signal contact members to form a first part of a connector body. A subarray of power contact members, which are held parallel to one another at one end via a connecting strip, then have another plastics material molded around them to form a second part of the body, which is molded onto the first part. All the connecting strips are separated off after the two stages of the injection molding process.

Known from U.S. Pat. No. 6,641,411 B1 is a high-density, high-speed connector wherein each signal conductor is always surrounded by four ground (earth) conductors. To reduce interference and reduced crosstalk between differential signal conductors provision is made in certain embodiments for the signal conductors to be so arranged in the connector that pairs of differential signals are orthogonal to one another.

Known from US 2008/0050969 A1 is an insertion-type connector having a plurality of parallel pins which are fastened into the connector. A printed circuit board is connected to the connector. Some of the pins are configured to transmit signals from the circuit board and other pins are electrically connected to a ground (earth) potential of the circuit board. The pins are so organized that some signal-conducting pins are surrounded by four pins carrying the ground.

SUMMARY OF THE INVENTION

Taking the above prior art as a point of departure, the object of the invention was to specify an improved, and in particular less expensive, method of manufacturing an insertion-type connector.

This object is achieved by a method identified and described herein and in the claims. Advantageous embodiments of the method according to the invention form the subject matter of the dependent claims and can be seen from the following description of the invention.

In a method of the above kind, provision is made in accordance with the invention for the plurality of second conductor contacts to form a conductor contact plate and not to be separated from one another, with the conductor contact plate being connected to the plurality of first conductor contacts via the connecting member.

This has the advantage that it is ensured, for the manufacture of the insertion-type connector, that all the conductor contacts are positioned relative to one another, what is finally done by the separating off of the connecting part being the separation not only of the first conductor contacts (which are in particular signal conductor contacts) from one another but also of the second conductor contacts (which are in particular earth conductor contacts) from the first conductor contacts, thus causing them to no longer have an electrically conductive connection to these latter.

The above and other objects, which will be apparent to those skilled in the art, are achieved in the present invention which is directed to a method of manufacturing an insertion-type connector having a plurality of first, mutually electrically insulated conductor contacts, the method including: cutting the first conductor contacts from a metal sheet such that they are connected together via a connecting part of the metal sheet; cutting a plurality of second conductor contacts which are connected together from the metal sheet; partially embedding the first and second conductor contacts in an electrically insulating material to form an electrically insulating housing, the housing fixing the conductor contacts relative to one another; and separating off the connecting part, wherein the plurality of second conductor contacts form a conductor contact plate and are not electrically separated from one another.

Before separating off the connecting part, the conductor contact plate is connected to the plurality of first conductor contacts via the connecting part.

The method further includes having the first conductor contacts and the second conductor contacts cut from the metal sheet and incorporated in the housing in such a way that a first conductor contact is in each case surrounded by four second conductor contacts.

The conductor contacts and the connecting part may be formed by stamping, punching or die-cutting. The conductor contacts may be formed into resilient contact tongues which project into openings in the housing. The resilient contact tongues may be bent during or after the cutting from the metal sheet.

The step of partially embedding the first and second conductor contacts may include molding around of a plastics material.

The housing forms a connector for connection to a mating insertion-type connector.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
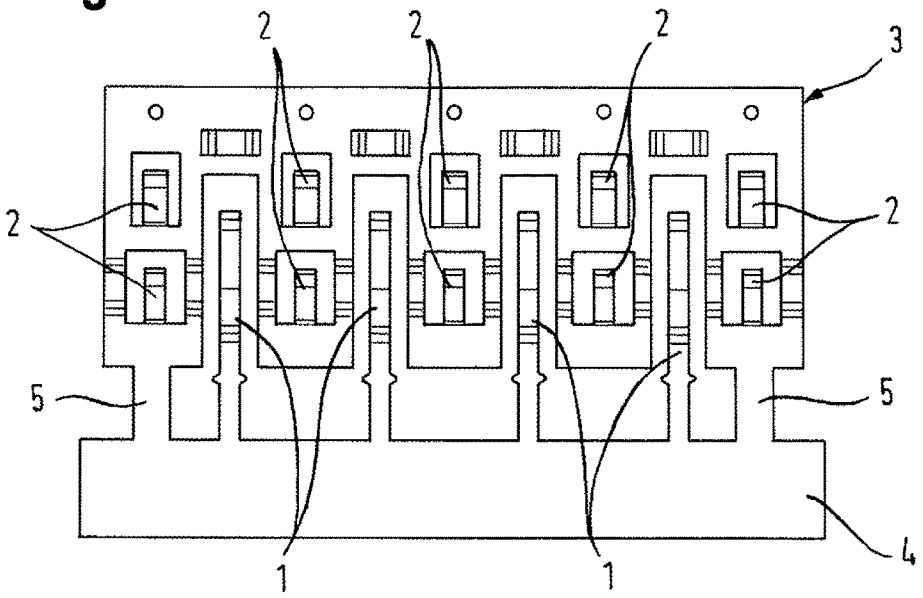
FIG. 1 is a plan view of a stamped metal component of first and second conductor contacts.

In describing the preferred embodiment of the present invention, reference will be made herein to FIGS. 1-6 of the drawings in which like numerals refer to like features of the invention.

The method according to the invention is distinguished by low unit costs for the insertion-type connector which is manufactured, because both the manufacture of the unit comprising the conductor contacts and connecting part by cutting it from a metal sheet and preferably by stamping, punching or die-cutting it, and the manufacture of the insulator/housing by embedding in an electrically non-conductive material and in particular plastics material, in particular by injection molding and similar methods such as injection compression molding, etc., are each, in themselves, methods which are inexpensive for mass production. Also, with the method according to the invention, any assembly is largely or entirely dispensed with because the incorporation of the conductor contacts in the insulator/housing takes place as part of the forming of the latter.

The plurality of first conductor contacts may for example be signal conductor contacts which are thus—in combination with a signal conductor contact of a corresponding mating insertion-type connector—the signal-transmitting connection of two signal lines (for example of a printed circuit board or of a cable and in particular of a co-axial cable). The plurality of second conductor contacts may for example be earth contacts.

Provision is therefore made for at least those conductor contacts which are preferably intended to be signal conductor contacts, and which are therefore mutually insulated when the insertion-type connector is subsequently being used, to be positioned via the connecting part during the embedding in the material of the housing.

The insertion-type connector according to the invention may be intended for radio frequency (RF) applications. The intention may in particular be for (identical or different) RF signals to be transmitted via the first conductor contacts. To achieve the requirements to be met by insertion-type connectors for RF applications with regard to the shielding of the signal conductors, provision may be made for the first and second conductor contacts to be cut from the metal sheet and incorporated in the housing in such a way that a first conductor contact is in each case surrounded by a plurality of, and in particular by four (which preferably form a square), second conductor contacts.

Also, to make the insertion-type connector suitable for RF applications, provision may also be made for the layout of the conductor contacts (and in particular the distance between them), and the choice of the electrically insulating material (including in particular its match with the air surrounding the parts of the conductor contacts which are not embedded in the plastics material, which air operates as a dielectric) to be selected in such a way that an impedance usual for RF applications (e.g. 50Ω) is obtained for the signal conductors or the unit comprising the signal and earth conductors.

The conductor contacts may preferably take the form of resilient contact tongues which project into openings in the housing and which are thus slightly deformed when connected to a corresponding conductor contact of a mating insertion-type connector and thereby generate an adequate contact-making pressure which makes it possible even for RF signals in particular to be transmitted reliably.

In an embodiment of method according to the invention which is moreover preferred, provision may be made for the separating off of the connecting part to take place at a defined distance (on the outside) from the housing, whereby connecting contacts may be formed via which the conductor contacts of the insertion-type connector can be connected to conductors of, for example, a printed circuit board or one or more (co-axial) cables. A connection of this kind may in particular be made by soldering, in which case the advantage can then be produced that the soldered points are situated in an easily accessible position outside the housing, where they can easily be subjected to a check on quality.

In an embodiment of method according to the invention which is moreover preferred, provision may be made for the housing to be so designed that it forms connecting means for connection to (the housing of) a mating insertion-type connector. The advantages of the forming of the housing in accordance with the invention by the forming and curing of a formable material and in particular by the injection molding of a plastics material come into play particularly well when this is the case because the connectors too can be produced at no additional expense. The unit costs for the insertion-type connector according to the invention can be kept particularly low in this way.

FIGS. 1 to 6 show a preferred embodiment of insertion-type connector manufactured by a method according to the invention. Specifically, FIGS. 1 to 6 show a preferred embodiment of insertion-type connector 10 manufactured by a method according to the invention in three stages of manufacture.

Figure 2:
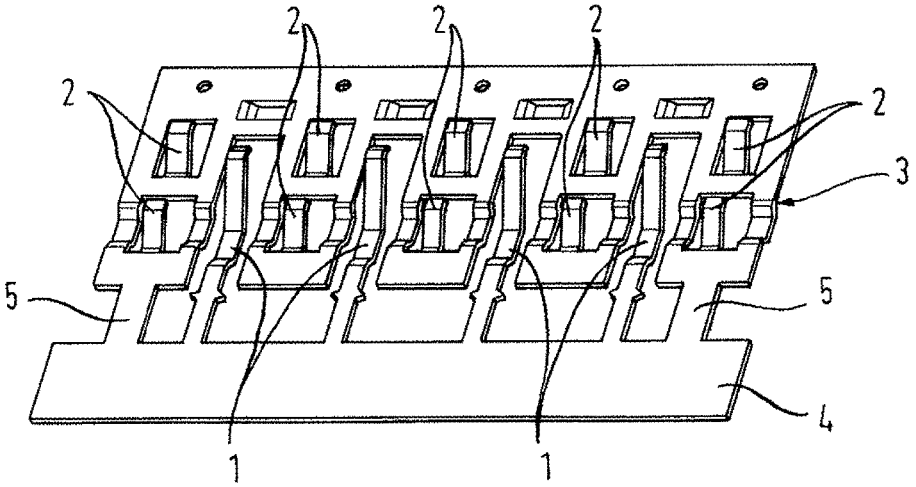
FIG. 2 is an isometric view of the stamped metal component of FIG. 1.

Shown in FIG. 1 (in a plan view) and in FIG. 2 (in an isometric view) is a stamped metal component. This stamped component forms a total of four first conductor contacts 1 and a total of ten second conductor contacts 2. The first conductor contacts 1 are to be used for the transmission of RF signals in the insertion-type connector, whereas the second conductor contacts 2 are intended to make a connection to earth. The second conductor contacts 2 take the form of resilient contact tongues and are an integral part of a conductor contact plate 3. All the second conductor contacts 2 are thus conductively connected together electrically.

The second conductor contacts 2 are connected as well (also in an electrically conductive manner), via a connecting part 4, to the first conductor contacts 1. The connecting part 4 likewise forms an integral part of the stamped component. Whereas the first conductor contacts 1 are all individually connected to the connecting part 4, a connection between the connecting part 4 and the conductor contact plate 3 which comprises the second conductor contacts 2 is made via two bridges 5.

Figure 3:
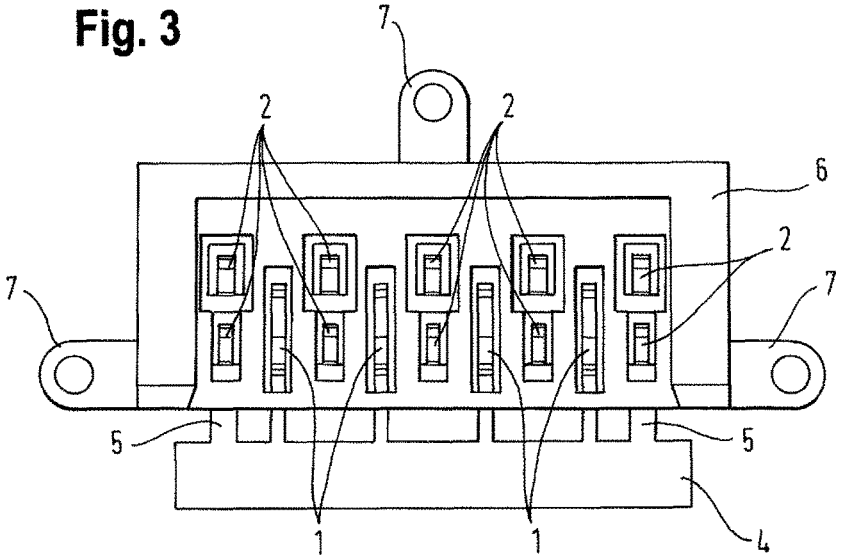
FIG. 3 is a plan view of a housing with the insertion-type connector of FIG. 1.
Figure 4:
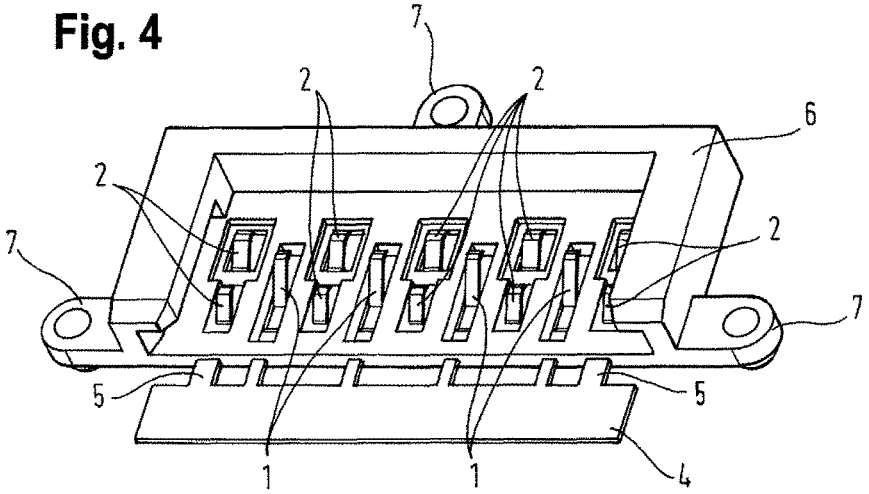
FIG. 4 is an isometric view of the housing of FIG. 3 with the insertion-type connector of FIG. 1.
Figure 5:
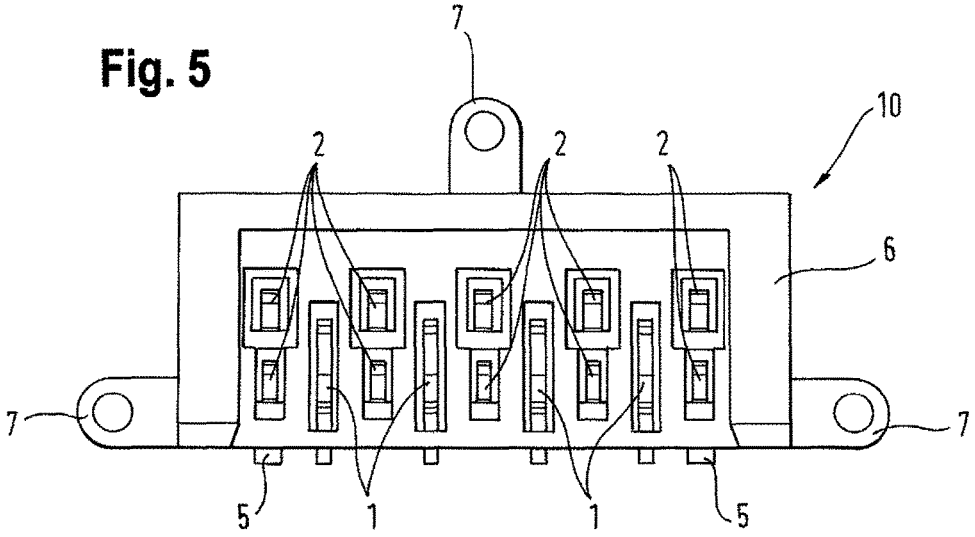
FIG. 5 is a plan view of the insertion-type connector of FIG. 3 with the connecting part removed.

Provision is made in accordance with the invention for an electrically insulating plastics material to be partly injection molded around the conductor contacts 1, 2 in order to form a housing 6 for the insertion-type connector in the way shown in FIG. 3 (in a plan view) and in FIG. 4 (in an isometric view). The housing 6 partly surrounds all the conductor contacts 1, 2, with one end of each of the conductor contacts 1, 2 being exposed in openings, thus enabling these conductor contacts to make contact with a mating insertion-type connector. Injection molding does not take place around the connecting part 4 or around short portions of the first conductor contacts 1 which follow on from it or around portions of the bridges 5 which connect the connecting part 4 to the conductor contact plate 3.

This enables the connecting part 4 to be separated off in a subsequent stage of the method (see FIGS. 5 and 6), the separating-off taking place at a defined distance from the edge of the housing 6. This leaves residual portions of the first conductor contacts 1 and of the bridges 5, of which one, some, or all may be used as connecting contacts to connect the first conductor contacts 1 and/or the conductor contact plate 3 to, for example, printed conductors of a printed circuit board by soldering.

Figure 6:
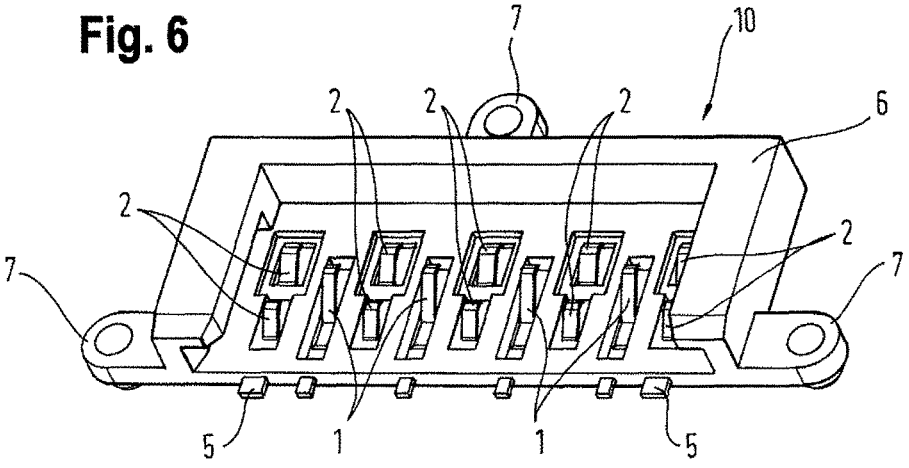
FIG. 6 is an isometric view of the insertion-type connector of FIG. 5.

As can be seen in particular from the isometric views shown in FIGS. 2, 4 and 6, both the first conductor contacts 1 and the second conductor contacts 2 take the form of resilient contact tongues of a configuration in which there are two angles (the operation of the first conductor contacts 1 as resilient contact tongues arises from their being embedded in the plastics material of the housing). This configuration is achieved by bending the conductor contacts 1, 2 as part of the stamping process. What is achieved by the double bend in the conductor contacts 1, 2 is that their free ends are arranged in a plane which is parallel to the plane of the unbent portions of the stamped component. The free ends of the conductor contacts thus project out of the housing 6.

The housing also comprises three fastening members 7 by which the insertion-type connector can be fastened onto, for example, the printed circuit board.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of manufacturing an insertion-type connector having a plurality of first, mutually electrically insulated conductor contacts, said method including:

cutting said first conductor contacts designed for transmission of RF signals from a metal sheet such that they are connected together via a connecting part of the metal sheet;

cutting a plurality of second conductor contacts, which are connected together from said metal sheet;

partially embedding the first and second conductor contacts in an electrically insulating material to form an electrically insulating housing; and separating off the connecting part, the separating-off taking place at a defined distance from the edge of the housing, wherein the plurality of second conductor contacts form a conductor contact plate and are not electrically separated from one another, and wherein residual portions of the first conductor contacts are used in soldered connections to other conductors;

such that said housing forms a connector for connection to a mating insertion-type connector.

2. The method of claim 1 wherein said housing fixes the conductor contacts relative to one another.

3. The method of claim 1, wherein the first conductor contacts and the second conductor contacts are cut from the metal sheet and incorporated in the housing in such a way that a first conductor contact is in each case surrounded by four second conductor contacts.

4. The method of claim 3 wherein the resilient contact tongues are bent during or after the cutting from the metal sheet.

5. The method of claim 1 including forming the conductor contacts and the connecting part by stamping, punching or die-cutting.

6. The method of claim 1 wherein said step of partially embedding said first and second conductor contacts includes molding around of a plastics material.

7. The method of claim 1 including forming the conductor contacts into resilient contact tongues which project into openings in the housing.

8. The method of claim 1, wherein, before separating off the connecting part, the conductor contact plate is connected to the plurality of first conductor contacts via the connecting part.

9. The method of claim 8 wherein the resilient contact tongues are bent during or after the cutting from the metal sheet.

10. A method of manufacturing an insertion-type connector having a plurality of first, mutually electrically insulated conductor contacts, said method including:

cutting said first conductor contacts designed for transmission of RF signals from a metal sheet such that they are connected together via a connecting part of the metal sheet;

cutting a plurality of second conductor contacts, which are connected together from said metal sheet;

partially embedding the first and second conductor contacts in an electrically insulating material to form an electrically insulating housing; and separating off the connecting part, the separating-off taking place at a defined distance from the edge of the housing, wherein the plurality of second conductor contacts form a conductor contact plate and are not electrically separated from one another, including leaving residual portions of the first conductor contacts of which one, some, or all are to be used as connecting contacts to connect the first conductor contacts to other conductors;

such that said housing forms a connector for connection to a mating insertion-type connector.

11. The method of claim 10 wherein connecting contacts to connect the first conductor contacts to other conductors is performed by soldering.

* * * * *